US005089107A

United States Patent [19]

Pacheco

[11] Patent Number: 5,089,107

[45] Date of Patent: Feb. 18, 1992

[54] BI-POLAR AUTO ELECTROLYTIC HYDROGEN GENERATOR

[76] Inventor: Francisco Pacheco, 60 Princeton Rd., P.O. Box 169, Hewitt, N.J. 07421

[21] Appl. No.: 555,037

[22] Filed: Jul. 18, 1990

[51] Int. Cl.[5] ..... C25B 9/00; C25B 11/04; C25B 15/02; C25B 15/08

[52] U.S. Cl. ..... 204/228; 204/240; 204/241; 204/248; 204/292; 204/256; 204/257; 204/DIG. 3; 204/238; 204/239

[58] Field of Search ..... 204/248, 249, 252–258, 204/262, 263–266, 240, 241, 292, DIG. 3, 238–239

[56] References Cited

U.S. PATENT DOCUMENTS 3,256,504 6/1966 Fidelman ..... 204/248
3,892,653 7/1975 Pacheco ..... 204/248 X
3,942,511 3/1976 Black et al. ..... 204/248 X
4,325,798 4/1982 Mack ..... 204/248

*Primary Examiner*—Donald R. Valentine

[57] ABSTRACT

An autoelectrolytic hydrogen generator system constituted by one or a plurality of similar cells wherein a galvanic arrangement of magnesium and aluminum plates of sacrificial elements as anode; stainless steel as cathode and sea water as electrolyte, by its very nature is made to develop a voltage when connected in short circuit causing a current to flow within the system and hydrogen production of hydrogen in situ and on demand by the electrolytic action at one pole, the cathode, and additional hydrogen by the electrochemical reaction at the other pole, the anode. Surplus electric energy of the system applied to a optional electrolyzer will also be made to produce additional hydrogen at its two sacrificial aluminum electrodes.

7 Claims, 2 Drawing Sheets

BI-POLAR AUTO ELECTROLYTIC HYDROGEN GENERATOR

BACKGROUND OF THE INVENTION

This invention relates in general to the production of electrolytic hydrogen from a suitable electrolyte: sea water, tap water sodium chloride solution or brine, particularly as a prime object to a technique that evolves hydrogen 99.98% pure at both electrodes of an electrolysis cell in which the arrangement and function of such electrodes are integrant parts of the invention.

In the electrolysis of brine or sea water, chlorine is produced at the anode, hydrogen together with sodium hydroxides at the cathode, i.e. "Dow cell".

Increasingly large amounts of hydrogen are used in industrial processes and actually as propeller fuel for space vehicles and in recent years is being recognized as the ideal one for automotive and other engines as well as utility fuel, inasmuch as its combustion with oxygen produces pure steam instead of pollutants, and with air minimal controllable emission of nitrogen oxides. While the proposed use of hydrogen for the above purposes is subject of many technical papers, actually, besides the NASA program there is not widespread commercial use of the concept, experimental work in projects to power automobiles fueled by hydrogen were and are actually performed in this Country, Europe and Japan, while every one demonstrated the excellence of the gas as energy carrier and its superior performance, in all cases hydrogen was and is supplied by the following methods:

1—PRESSURIZED
2—LIQUEFIED
3—STORED IN METALLIC HYDRIDES

The major factor that actually precludes the use of the gas hydrogen as automobile fuel or for that matter as utility fuel is that beside the problems of storage an delivery, the cost of production with the known techniques in amounts equivalent in terms of BTU's of energy, exceeds greatly the cost of conventional fossil fuels, even considering the fact that weight by weight, hydrogen is three times more powerful than gasoline.

The invention's disclosure will lead to the evidence that the cost of hydrogen will be appreciably reduced inasmuch as it is evolved at both electrodes, cathode and anode of the generator. The invention represents the solution of storage and delivery problems since the gas is produced in situ and on demand as described further, also represents a radical departure from the conventional electrolysis of sea water or brine and its results.

The electrolysis cell described in drawing (1) consists of: 1—CATHODE, the stainless steel lining of the plastic vessel and its permanently connected twin stainless steel plates between the anode banks. 2—ANODE BANKS, consisting of an arrangement of magnesium plates (key element of the system), permeable separators and aluminum plates. 4—The sea water as the electrolyte.

By its nature the cell as described above, is also a galvanic arrangement of elements that makes of it a source of electricity with a nominal 1.5 volts as difference of potential in open circuit at its plus and minus terminals and a negligible chemical reaction between magnesium and the electrolyte.

Referring to a single cell; when a variable load closes the circuit, an electric current flows trough the system, current that is inversely related to the load resistance and directly to the surface of the electrodes. The electric energy causes the magnesium anode to produce chlorine, the chemical reaction of the magnesium with the electrolyte produces hydrogen that is liberated at this electrode (anode). Hydrogen and sodium hydroxides are produced by electrolysis at the stainless steel cathode, the hydrogen is liberated at this electrode (cathode); the aluminum component of the anode slowly at first, reacts also chemically with the sodium hydroxides produced, and the resultant hydrogen increases the total output. It is not well understood, other than by speculative theory (time element?), the action of the permeable separator between the metals magnesium and aluminum, however and being incontrovertible the fact that it causes to be produced an excess of hydrogen above the predictable quantities produced by electrochemical reactions, this fact is disclosed and incorporated as principal and very important part of the invention.

The system produces analytically tested, hydrogen of 99.98 percent purity being evolved at the two electrodes with no traces detected of chlorine. Also as byproducts the cell produces magnesium and aluminum hydroxides that when recuperated from the system, represent the stock material industrially obtained from sea water and bauxite as first step in the industrial production of the mentioned elements, magnesium and aluminum.

SUMMARY OF THE INVENTION

In view of the foregoing it is the main object of this invention to provide an autoelectrolytic hydrogen generator making use of 30% of the total electric energy employed to industrially produce the elements magnesium and aluminum from sea water and bauxite, the invention makes use of such elements as an ideal and fully charged electric storage system.

More particularly it is an object of this invention to provide a hydrogen generator of the above identified type wherein the electric energy obtained by the arrangement of magnesium and aluminum as sacrificial metals is exploited to evolve electrolytic hydrogen at one electrode and electrochemical reactions to produce also hydrogen at the other electrode.

Also an object of the invention is to provide a system eliminating the problem of hydrogen storage inasmuch as the so far disclosed arrangement of the metals will produce hydrogen directly from sea water, its natural storage as electrolyte, only on demand and in situ thus effectively eliminating consequent expenses and hazards that are related to hydrogen stored under pressure or in liquid form.

Still another object of the invention is to provide a system in which the voltage generated in one or more cells wherein hydrogen is being produced electrochemically also serves to effect electrolysis in these cells and in a optional electrolyzer to increase the total volume of hydrogen output.

Briefly stated, these objects are attained in one basic embodiment of the invention wherein a voltaic sell constituted by magnesium-aluminum sacrificial anode, a stainless steel cathode and sea water as electrolyte is provided with an external flow loop and a pump powered by the cell surplus electric energy to: 1—circulate the electrolyte. 2—filter the same to separate it from the metal hydroxides. 3—to utilize the thermal output of the system in an independent heath exchange coil.

In another embodiment of the invention, to a plurality system of said basic cells an optional, conventional electrolyzer is attached at, wherein the surplus electric energy of the system is applied and additional electrolytic hydrogen produced also at both electrodes made of aluminum.

OUTLINE OF THE DRAWING

For a better understanding of the invention as well as other objects and further features thereof, reference is made to the detailed description and read in conjunction with the included drawing wherein.

DESCRIPTION OF THE INVENTION

First embodiment

Figure 1:
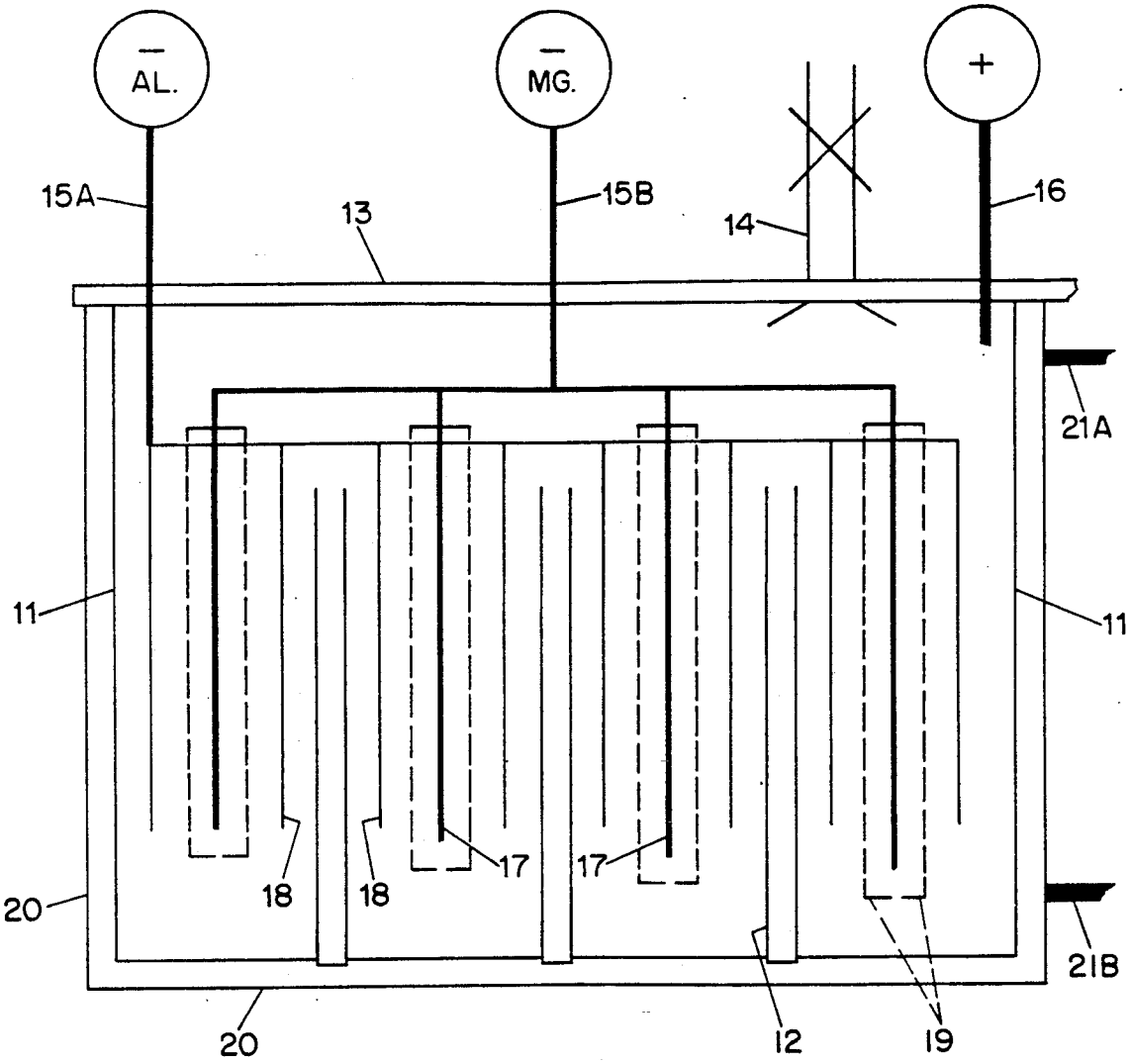
FIG. 1 is a schematic diagram of the basic embodiment of the invention.

Referring now to FIG. 1, there is shown a basic hydrogen generating cell in accordance with the invention in which sea water as electrolyte is contained in a tank 10 fabricated of a high strength non-reactive plastic material, the internally stainless steel tank lining 11 and the permanently connected twin plates 12 of the same metal constitutes the cathode. The cover 13 of the tank 10 includes a gas outlet 14 and the terminals 15A, 15B (−) and 16 (+).

Immersed in the electrolyte and supported within the tank 10 are the plates of magnesium 17 and aluminum 18 together with the separator 19, an arrangement that constitutes the anode. External terminals of magnesium and aluminum to be connected when operating the cell. Since the cell generates the electric energy for the electrolysis, the cell operates as an auto-electrolysis device requiring no external energy source.

Second embodiment

Figure 2:
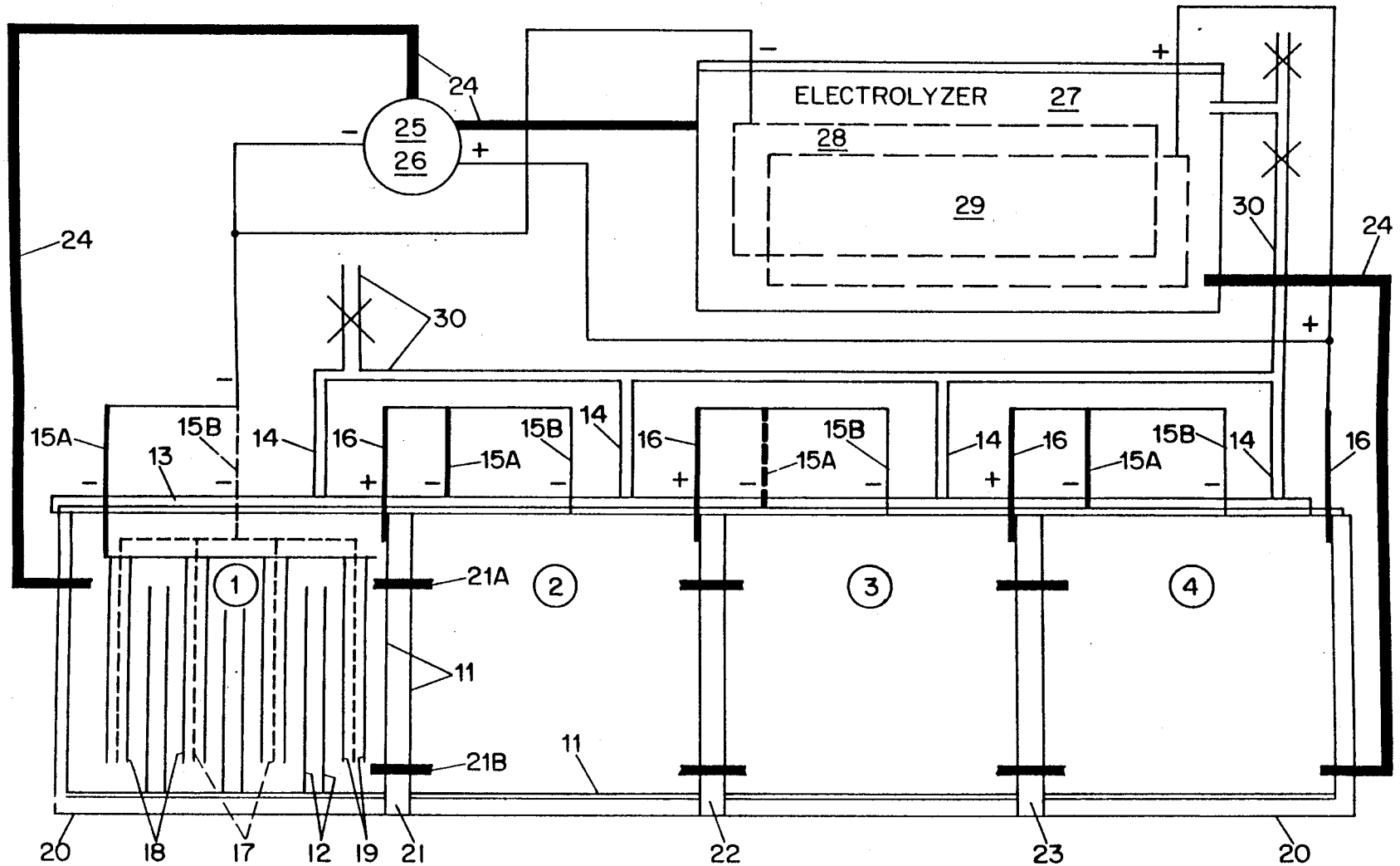
FIG. 2 is a schematic diagram of a preferred embodiment of the invention.

The arrangement in FIG. 2, shows a group of hydrogen generator cells 1, 2, 3, and 4. identical in every detail as described in the first embodiment that are located within a plastic tank 20 with three partitions 21, 22, and 23 and provided with electrolyte circulating ports such as 21A and 21B.

In closing the circuit onto itself, the cells 1, 2, 3, and 4, connected in series, will develop about four times the voltage of a single cell.

An external flow loop 24 may be coupled to the tank 21 including a strainer 25 and a pump 26 that powered by the voltage derived from the system will separate the insoluble hydroxides from the electrolyte.

As disclosed, the four cells electric energy output may be utilized to operate as an integrant part of this embodiment an optional electrolyzer cell 27 that will evolve additional hydrogen also at both electrodes 28 and 29, being these electrodes made of aluminum. A manifold 30 is provided to discharge the total volume of hydrogen produced by the system.

While there has been shown preferred embodiments of the invention, it will be appreciated that many modifications and changes may be made without, however, departing from the essential spirit of the invention. For example, utilizing the electric energy developed by the system, the nature of the electrolyte and elements of the electrodes 28 and 29, of the electrolyzer cell 27. proper and known changes can be achieved.

I claim:

1. A bi-polar auto electrolytic hydrogen generating system comprising:

(a) at least one voltaic cell comprising:

(i) a non conductive air-impermeable tank comprising a stainless steel inner tank lining adapted for containing a salt-water electrolyte selected from the group consisting of sea water, brine, and an aqueous solution of sodium chloride, and a cover portion having a hydrogen outlet located above said tank lining, (ii) a first electrode portion located within the tank and comprising the stainless steel inner tank lining and a plurality of pairs of stainless steel plates permanently affixed to the inner tank lining, wherein said first electrode portion is provided with a (+) terminal located externally on the cover portion of the tank, and (iii) a second electrode portion comprising a plurality of sets of magnesium plates, a plurality of sets of aluminum plates, and a plurality of non-conductive permeable separators, wherein each magnesium plate is arranged between a pair of separators all adapted to be immersed in the electrolyte, and said second electrode portion is provided with (−) terminals located externally on the cover portion of the tank; and (b) a variable load resistor external to the cell which may be connected, at will, across the positive (+) and negative (−) terminals of the system to develop a voltage and a controlled current in the cell, inversely proportional to the resistance of said variable load resistor, thereby evolving hydrogen, autoelectrolytically and electrochemically from the electrolyte, on demand at said first and second electrode portions, in a volume directly proportional to the current produced by the total surface area of the electrodes.

2. A system according to claim 1, in which each pair of stainless steel plates is arranged within the tank so that each pair of stainless steel plates resides between each set of aluminum and magnesium plates of said second electrode portion.

3. A system according to claim 1, in which a plurality of voltaic cells are electrically connected in series to one another, and have a flow loop therebetween to permit the flow of electrolyte through each cell.

4. A system according to claim 3, in which the plurality of voltaic cells is in communication with an external flow loop to effect continuous circulation of electrolyte through each cell, the loop including an electrically-operated pump for pumping the electrolyte through the loop, wherein the pump is electrically connected to the load resistor and powered by the voltage produced from the cell.

5. A system according to claim 4, in which the loop further includes a heat-exchange coil to cool the electrolyte and produce a thermal output.

6. A system according to claim 4, in which the loop further includes a filter to separate hydroxides of magnesium and aluminum from the electrolyte.

7. A system according to claim 4, in which the loop further includes an electrolyzer cell having electrodes therein connected across the load resistor, wherein hydrogen is additionally evolved from the electrolyzer cell and combined with hydrogen produced from the voltaic cells.

* * * * *